US006047647A

United States Patent [19]

Laraia, Jr.

[11] Patent Number: 6,047,647

[45] Date of Patent: Apr. 11, 2000

[54] ADJUSTABLE SHELF ASSEMBLY

[76] Inventor: Frank A. Laraia, Jr., 393 Twin Creeks Dr., Bolingbrook, Ill. 60440

[21] Appl. No.: 09/245,544

[22] Filed: Feb. 5, 1999

[51] Int. Cl.[7] ..... A47B 57/00

[52] U.S. Cl. ..... 108/61; 211/184

[58] Field of Search ..... 108/60, 61, 180, 108/153.1; 211/184

[56] References Cited

U.S. PATENT DOCUMENTS

| | | | |
|---|---|---|---|
| D. 286,596 | 11/1986 | Leo, Sr. . | |
| 584,167 | 6/1897 | Shanklin . | |
| 1,046,488 | 12/1912 | Pauley . | |
| 1,231,005 | 6/1917 | Erickson . | |
| 2,483,769 | 10/1949 | Hickey | 211/184 X |
| 2,820,684 | 1/1958 | Zadek et al. | 108/61 X |
| 2,915,193 | 12/1959 | Bromberg . | |
| 2,976,510 | 3/1961 | Blain . | |
| 3,408,128 | 10/1968 | Kump . | |
| 3,504,956 | 4/1970 | Schottland | 211/184 X |
| 3,807,572 | 4/1974 | Luvara et al. | 108/61 |
| 4,476,985 | 10/1984 | Norberg et al. . | |
| 4,685,574 | 8/1987 | Young et al. | 211/184 X |
| 5,148,927 | 9/1992 | Gebka | 108/60 X |
| 5,199,584 | 4/1993 | Fowler et al. . | |
| 5,203,463 | 4/1993 | Gold | 211/184 X |
| 5,255,802 | 10/1993 | Krinke et al. . | |
| 5,450,968 | 9/1995 | Bustos | 21/184 X |
| 5,582,305 | 12/1996 | Howell, Sr. et al. | 211/184 X |

FOREIGN PATENT DOCUMENTS

| | | | |
|---|---|---|---|
| 1461214 | 12/1966 | France | 211/184 |

*Primary Examiner*—Jose V. Chen
*Attorney, Agent, or Firm*—Trexler, Bushnell, Giangiorgi & Blackstone, Ltd.

[57] ABSTRACT

An adjustable shelf assembly for storing products. The assembly includes a base and a generally upstanding front member including a plurality of teeth defining a plurality of slots along the length of the front member. The front member and the base include interlocking structure for removably interlocking the front member and the base together. The assembly includes a plurality of generally upstanding dividers removably engageable at alternative locations along the length of the front member for forming a plurality of rows and adjusting the number and width of the rows. Each divider is adapted to at least one of: (1) be alternatively and adjustably received within the slots defined by the teeth of the front member; and (2) alternatively and adjustably receive the teeth of the front member. The assembly also includes a plate member where the front member and plate member are configured such that the plate member is removably attachable to the front member for supporting products on the shelf assembly.

31 Claims, 3 Drawing Sheets

ADJUSTABLE SHELF ASSEMBLY

FIELD OF THE INVENTION

This invention relates generally to shelf assemblies and more specifically relates to an adjustable shelf assembly for storing, for example, products in a retail store.

BACKGROUND OF THE INVENTION

Typically, shelves are used to display and store products which are for sale in a retail store, such as in a grocery store. Specifically, products of a similar type are normally grouped in a particular area of the store, and the products are further segregated on the shelves by brand name. Because shelf space is limited, it is beneficial to display as many items as possible in the smallest amount of shelf space while still keeping groups of products separate from each other. In other words, it is beneficial to maximize the amount of shelf space which is actually used while still keeping certain items segregated from others (e.g. keeping laundry detergent segregated from fabric softener, or keeping one brand of laundry detergent segregated from another brand of laundry detergent).

One type of shelf which is typically used in a retail setting provides a long flat, uninterrupted surface on which to store and display products. A disadvantage to such a shelf is that as customers engage the products on the shelf, the products tend to be moved out of order. In other words, products of one brand tend to become mixed with products of another brand, or different types of products tend to become mixed together. As a result, considerable time and care must be taken to constantly produce an orderly and attractive arrangement of products on the shelf. Also, as the products become moved out of order, some products may become hidden behind others on the shelf. As a result, some items may not be visible to customers, or may become difficult for customers to access.

Although it has been known to use dividers to segregate products on a shelf, such dividers cannot be adjusted readily to accommodate changes of the shelved products and, more particularly, changes in the size of the shelved products. This is a shortcoming because the products stored on particular shelves typically change over time. Thus, there is a need for a shelf assembly that not only keeps the shelved products aligned but that also can be readily adjusted to accommodate changes in the shelved products.

OBJECTS AND SUMMARY OF THE INVENTION

Accordingly, it is a general object of the present invention to provide an adjustable shelf assembly which includes dividers that segregate products stored on the assembly, and which can be used to readily adjust the number and width of rows on the shelf.

An additional object of the present invention is to provide an adjustable shelf assembly which can be readily adjusted to accommodate groups of products having different sizes.

Another object of the present invention is to provide an adjustable shelf assembly which maintains products in an orderly arrangement.

Briefly, and in accordance with one or more of the foregoing objects, an embodiment of the present invention provides an adjustable shelf assembly for storing products. The assembly includes a base and a generally upstanding front member including a plurality of teeth defining a plurality of slots along the length of the front member. The front member and the base include interlocking structure for removably interlocking the front member and the base together. The assembly includes a plurality of generally upstanding dividers removably engageable at alternative locations along the length of the front member for forming a plurality of rows and adjusting the number and width of the rows. Each divider is adapted to at least one of: (1) be alternatively and adjustably received within the slots defined by the teeth of the front member; and (2) alternatively and adjustably receive the teeth of the front member.

In one embodiment of the present invention, the dividers generally have an inverted U-shaped cross section, and are adapted both to be alternatively and adjustably received within the slots defined by the teeth of the front member and to alternatively and adjustably receive the teeth of the front member. Desirably, a width the teeth of the front member is generally equal to a width of the slots defined by the teeth, and the slots are defined by a plurality of walls of the front member and are positioned in spaced apart relation along the length of the front member.

In another embodiment of the present invention, the dividers are generally rectangular shaped, and are adapted to be alternatively and adjustably received within the slots defined by the teeth of the front member.

It is preferred that the base and front member are configured such that when they are interlocked together, they generally form a ninety degree angle relative to each other. It is also preferred that the base be configured for securement to a shelf surface. Specifically, the base may define a plurality of holes for securing the base to the shelf surface, where the holes are arranged in spaced apart relation along a length of the base.

The assembly preferably also includes a plate member where the front member and the plate member are configured such that the plate member is removably attachable to the front member for supporting products on the shelf assembly. Desirably, the front member defines a channel and the plate member is removably received in the channel. Preferably, when the plate member is removably attached to the front member, they generally form a ninety degree angle relative to each other. Desirably, the plate member is configured such that products can generally be seen therethrough.

The assembly also preferably includes a sheet member adapted to rest on the base, as well as a rear member associated with the base where the rear member includes a plurality of teeth defining a plurality of slots complementary to the slots in the front member.

BRIEF DESCRIPTION OF THE DRAWINGS

The present invention will now be described by way of example with reference to the accompanying drawings in which like reference numerals designate like parts and in which.

DESCRIPTION OF EMBODIMENTS OF THE INVENTION

Figure 1:
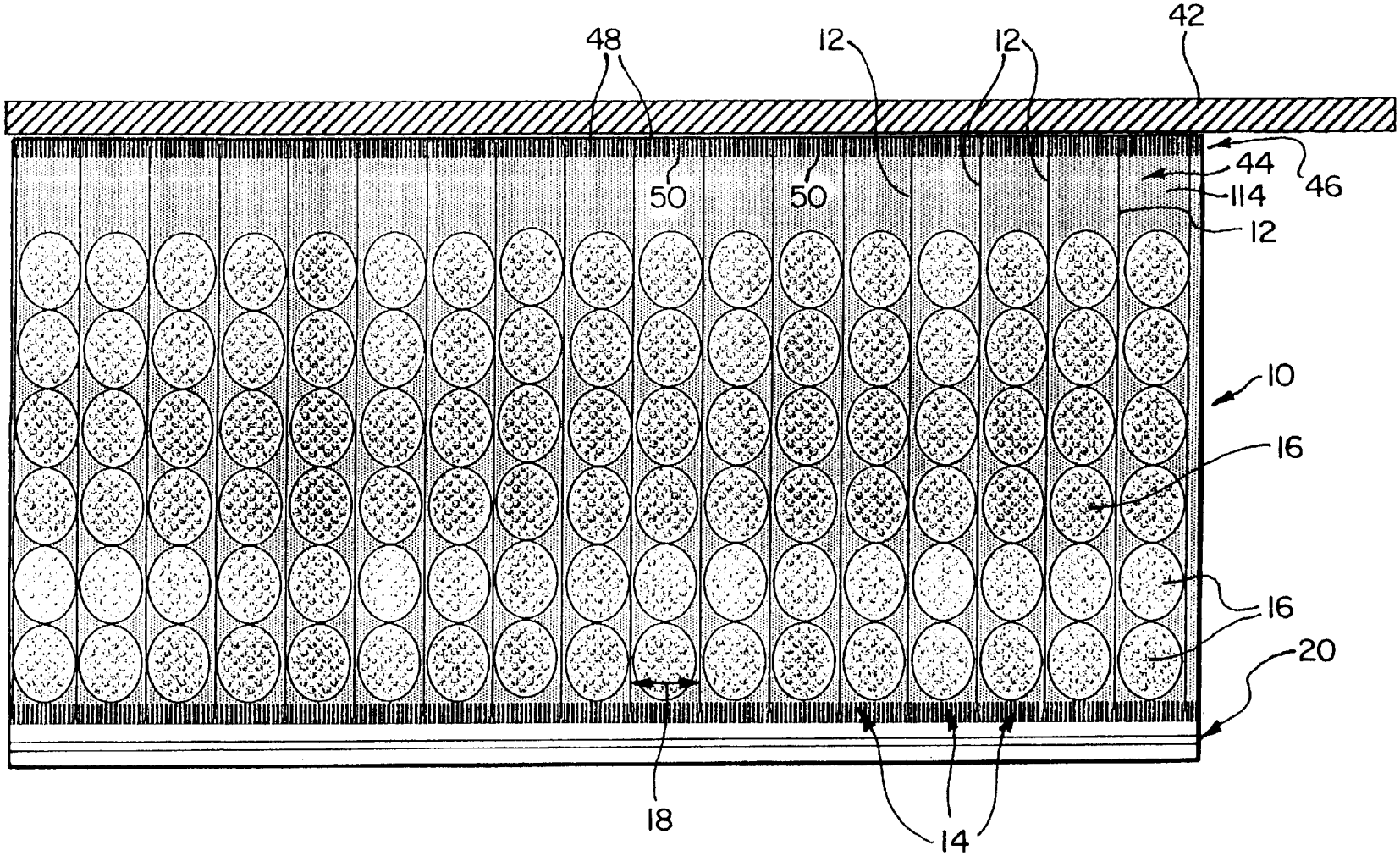
FIG. 1 is a top plan view of a shelf assembly which is in accordance with an embodiment of the present invention, illustrating dividers engaged in slots in a front member and in slots in a rear member to provide rows for storing products on the assembly.

Illustrated in FIG. 1 is a shelf assembly 10 which is in accordance with an embodiment of the present invention. The shelf assembly 10 includes dividers 12 which define rows 14 that align products 16 stored on the shelf assembly 10, and the dividers 12 keep products 16 in one row separate from products 16 in adjacent rows. As will be described more fully later herein, the dividers 12 are removable from the assembly 10 thereby providing that a width 18 of a given row can be varied, and that the total number of rows can be varied. Because the width of the rows can be varied, the shelf assembly 10 can efficiently accommodate groups of products having different sizes. Specifically, when it is desired to display a different product on the shelf assembly, one or more divider members 12 can be moved, added or removed, as the case may be, quickly and easily to accommodate the different product. Additionally, because the dividers 12 keep products in one row separate from products in adjacent rows, the shelf assembly 10 maintains the products 16 in an orderly arrangement. As will be described more fully later herein, preferably the shelf assembly 10 also includes structure which tends to keep the products from falling from the front of the shelf assembly, and preferably the products can generally be seen through the structure.

Figure 2:
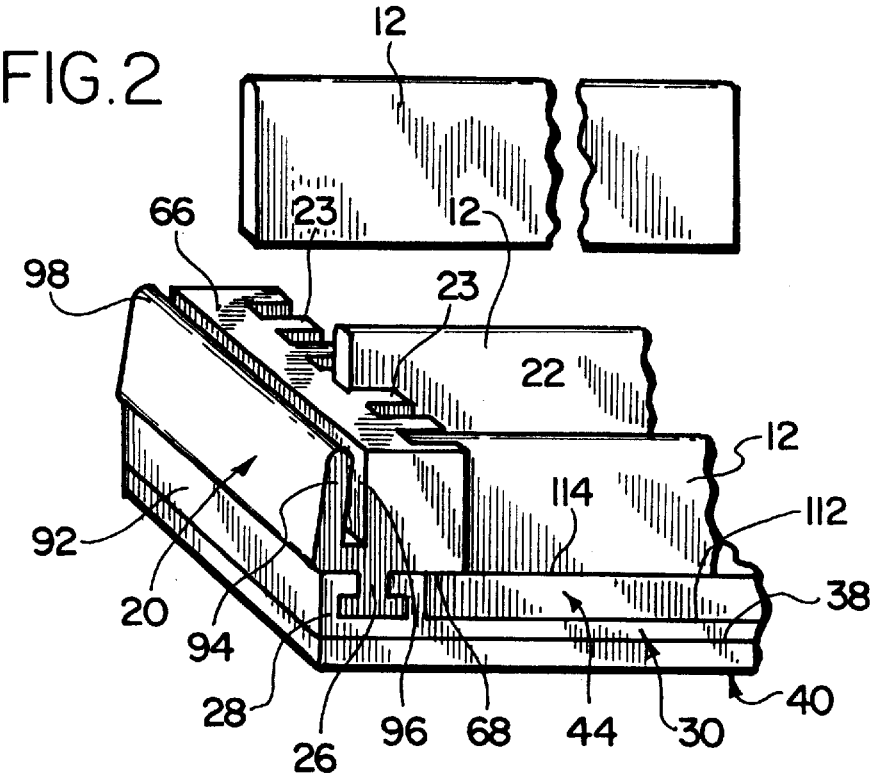
FIG. 2 is a perspective view of a portion of the shelf assembly illustrated in FIG. 1, illustrating dividers engaged in slots in the front member as well as a base engaged with a front member.
Figure 3:
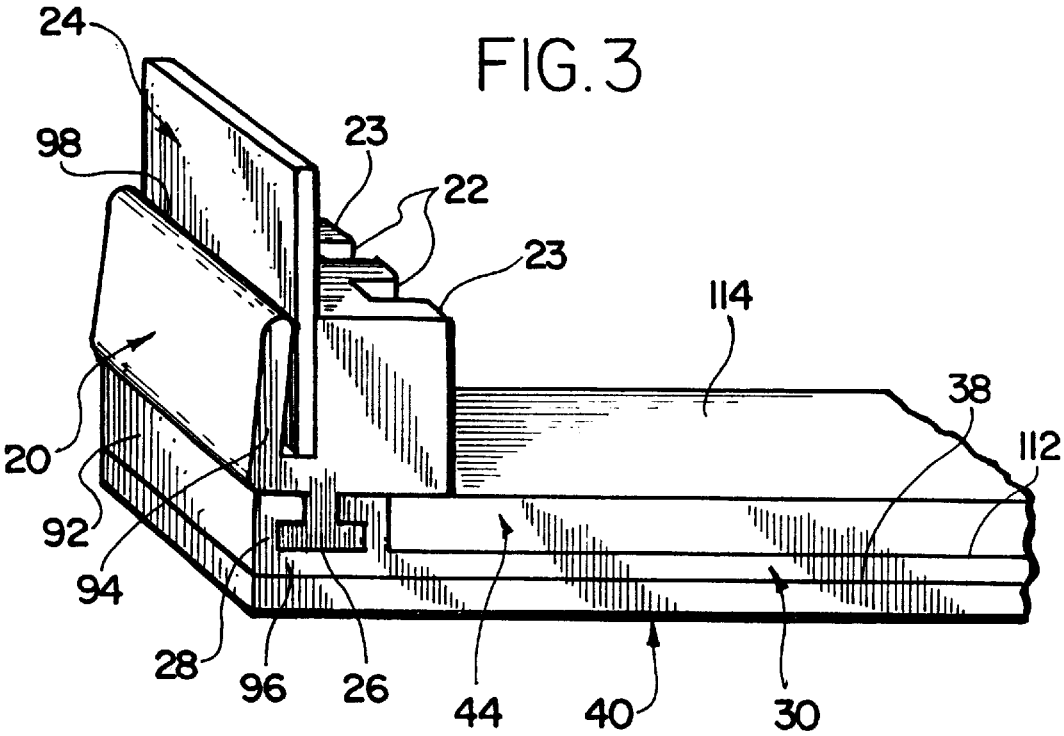
FIG. 3 is a perspective view, similar to FIG. 2, of a portion of the shelf assembly illustrated in FIG. 1, with the dividers removed from the slots in the front member, and illustrating a plate member engaged with the front member.

Specifically, as illustrated in FIGS. 1–3, the shelf assembly 10 includes a generally upstanding front member 20 which includes teeth 23 that define slots 22 along a length of the front member 20, wherein the slots 22 are configured to removably receive the dividers 12 (see FIGS. 1 and 2). Preferably, the front member 20 is configured for also removably receiving a plate member 24. The front member 20 includes interlocking structure 26 for engaging corresponding interlocking structure 28 on a base 30, and the base 30 is preferably engaged with a surface 38 of a shelf 40 (see FIGS. 2 and 3) which is secured to a wall 42 (see FIG. 1). Desirably, a sheet member 44 is adapted to rest on the base 30, preferably against the interlocking structure 28 on the base 30. Additionally, preferably the assembly 10 includes a generally upstanding rear member 46 (see FIG. 1) which is engaged with the base 30 and includes teeth 50 that define slots 48 which are configured to removably receive rear portions of the dividers 12, where the slots 48 and teeth 50 on the rear member 46 are generally complementary to and align with the slots 22 and teeth 23, respectively, in the front member 20. Alternatively, the shelf assembly 10 can be utilized without a rear member 46.

Figure 5:
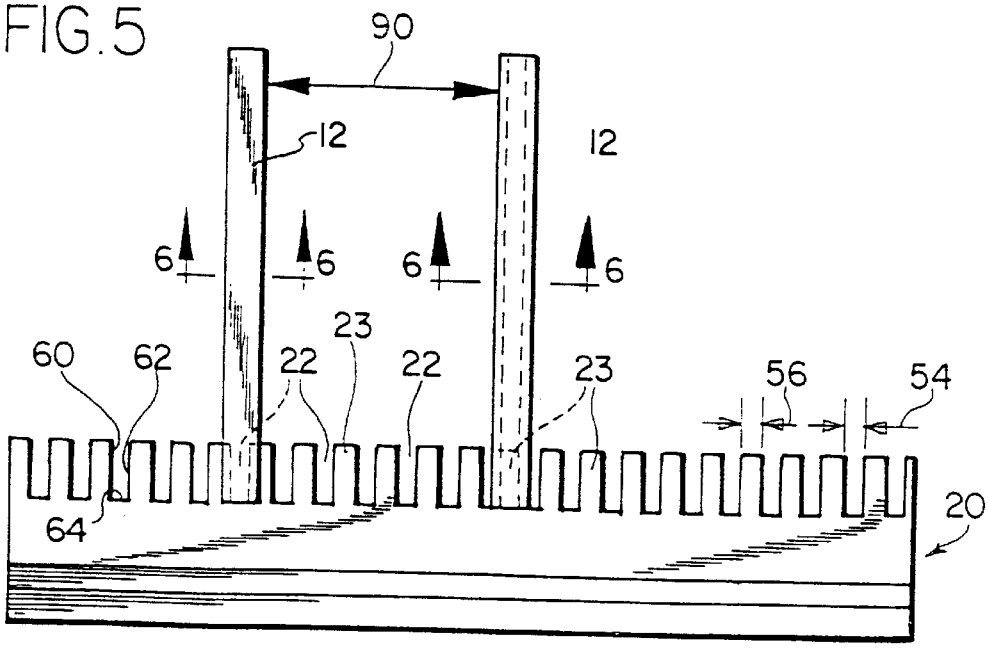
FIG. 5 is a top plan view of the front member illustrated in FIGS. 2 and 3, illustrating a divider engaged with teeth of the front member and a divider engaged in a slot in the front member, in accordance with a second embodiment of the present invention.

As shown in FIG. 5, preferably the front member 20 defines a plurality of alternating slots 22 and teeth 23 along the length of the front member 20 such that the slots 22 and the teeth 23 are positioned in spaced apart relation along the length of the front member 20. Desirably, each slot 22 is defined by a plurality of walls 60, 62, 64 of the front member 20. Specifically, preferably each slot 22 is defined by two generally parallel walls 60 and 62 which intersect a front wall 64. Preferably, the slots 22 and teeth 23 extend from a top surface 66 of the front member to a bottom surface 68 thereof (see FIGS. 2 and 3), and the slots 22 are configured to removably receive the dividers 12. Specifically, as illustrated in FIG. 2, the dividers 12 may be generally rectangular and may be adapted to be alternatively and adjustably received within the slots 22 defined by the teeth 23 of the front member 20.

Figure 6:
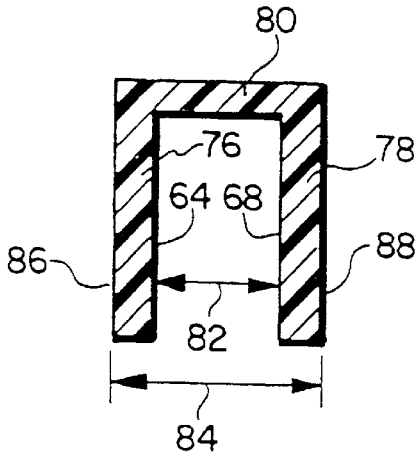
FIG. 6 is a cross-sectional view, taken along line 6—6, of either one of dividers illustrated in FIG. 5, wherein the cross-section is in accordance with the second embodiment of the present invention.

Alternatively, as illustrated in FIG. 5, the dividers 12 may be configured such that they can both be alternatively and adjustably received within the slots 23 defined by the teeth 22 of the front member 20 and can alternatively and adjustably receive the teeth 22 of the front member 20. To this end, as illustrated in FIG. 6, the dividers 12 may generally have an inverted U-shaped cross-section including two generally parallel walls 76, 78 depending from a top wall 80, where a width 82 between inside surfaces 64, 68 of the two generally parallel walls 76, 78 define an inside dimension, and a width 84 between outside surfaces 86, 88 of the two generally parallel walls 76, 78 define an outside dimension. Preferably, the inside dimension 82 of the dividers 12 provides that the dividers 12 can removably receive the teeth 23 of the front member 20 (see the rightmost divider 12 illustrated in FIG. 5) while the outside dimension 84 provides that the dividers 12 can also be removably received in the slots 23 of the front member 20 (see the leftmost divider 12 illustrated in FIG. 5). This provides for a greater resolution of placement of the dividers 12 along the length of the front member 20, and therefore more latitude in defining rows using the dividers 12. Preferably the width 54 of each slot 23 is generally equal to the width 56 of each tooth 22 along the length of the front member 20. Regardless of the shape of the dividers 12, preferably they are comprised of plastic; however, they may consist of any other suitable material.

As discussed above, the dividers 12 may be configured to engage in the slots 22 on the front member 20 or to engage in the slots 22 as well as the teeth 23 which define the slots 22. Still further, the dividers 12 may be configured to only engage the teeth 23 on the front member 20, and not to engage in the slots 23. As a result, the front member 20 need not have both slots 22 and teeth 23, and may instead have only slots 22 or only teeth 23 for removably receiving the dividers 12. Additionally, the dividers 12 may be provided as having a shape which is different than is illustrated in FIGS. 2, 5 and 6 while still remaining within the scope of the present invention Regardless, as discussed above, the dividers 12 are preferably provided as being removable from the assembly 10, and this provides that the width of a given row can be adjusted and that the total number of rows can be varied. For example, in FIG. 5, if the leftmost divider 12 were removed from the slot 22 in which it is engaged, and is then engaged in a slot 22 which is two slots to the right, the row defined by the space 90 between the dividers 12 would become more narrow. Likewise, if additional dividers 12 were engaged with the front member 20 illustrated in FIG. 5, the total number of rows would be increased. Because the width of the rows can be varied, the shelf assembly 10 can efficiently accommodate groups of products having different sizes. Specifically, when it is desired to display a different product on the shelf assembly, one or more divider members 12 can be moved, added or removed, as the case may be, quickly and easily to accommodate the different product. Additionally, because the dividers keep products in one row separate from products in adjacent rows, the shelf assembly 10 maintains products in an orderly arrangement.

Some of the structure briefly discussed above will now be described in more detail. As shown in FIGS. 2 and 3, the interlocking structure 26 on the front member 30 preferably consists of a generally T-shaped protrusion on the bottom surface 68 of the front member 20, and the interlocking structure 28 on the base 30 preferably consists of a generally T-shaped keyway or recess generally at a front end 92 of the base 30. When the T-shaped protrusion on the bottom surface 68 of the front member 20 is received in the T-shaped keyway generally at the front end 92 of the base 30, preferably the front member 20 and base 30 are securably, yet removably interlocked. When the front member 20 and base 30 are interlocked, they are preferably positioned generally ninety degrees relative to each other. When the front member 20 is engaged with both the base 30 and the plate member 24, preferably the base 30 and the plate member 24 are also positioned generally ninety degrees relative to each other.

As discussed above, the front member 20 is preferably configured to removably receive a plate member 24. Specifically, as shown in FIGS. 2 and 3, the front member 20 may include a front wall 94 which defines a channel 96 for removably receiving the plate member 24. As illustrated, preferably the front wall 94 of the front member 20 is angled slightly inward, toward the channel 96, to provide that a top portion 98 of the front wall 94 pinches the plate member 24 and tends to keep the plate member 24 generally retained in the channel 96 unless a user were to pull upward on the plate member 24 to intentionally remove the plate member 24 from the channel 96. Alternatively, the front wall 94 may not be angled slightly inward, toward the channel 96, and may instead point directly upward. In either case, preferably the plate member 24 is configured such that products can generally be seen through the plate member 24, and is configured such that it tends to support the products on the shelf assembly 10. In other words, preferably the plate member 24 is configured such that when it is engaged with the front member 20, the plate member 24 tends to keep products from falling forward off the shelf assembly 10. As illustrated in FIG. 2, the plate member 24 may be generally rectangular. The plate member 24 may consist of, for example, a clear plastic, generally rectangular plate.

Figure 4:
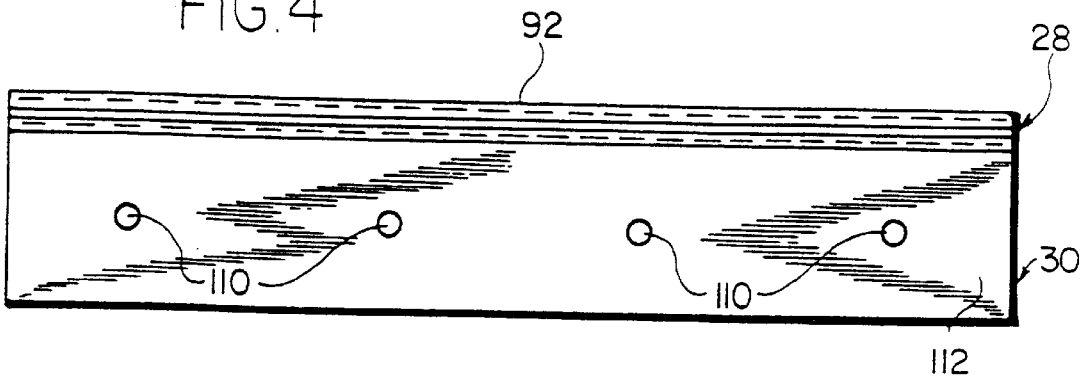
FIG. 4 is a top plan view of a base of the shelf assembly illustrated in FIGS. 2 and 3.

As briefly discussed above, and as illustrated in FIGS. 2 and 3, preferably the base 30 is engaged with a surface 38 of a shelf 40, and the shelf 40 is secured to a wall 42 (see FIG. 1). As illustrated in FIG. 4, preferably the base 30 has a plurality of holes 110 for receiving fastening members (not shown) which secure the base 30 to the shelf surface 38, and the holes 110 are arranged in spaced apart relation along a length of the base 30. As illustrated in FIGS. 2–4, preferably a generally flat surface 112 extends from the interlocking structure 28, and it is preferably generally along the length of this generally flat surface 112 that the holes 110 are located (see FIG. 4).

As also discussed above, preferably a sheet member 44 rests on the base 30. Specifically, as illustrated in FIGS. 2 and 3, it is preferred that the sheet member 44 rest on the flat surface 112 of the base 30, and rest against the interlocking structure 28. The sheet member 44 may comprise a corrugated plastic sheet, or any other suitable material. Preferably, a top surface 114 of the sheet member 44 has an aesthetically pleasing appearance since the top surface 114 of the sheet member 44 generally will be exposed wherever there is no product. Additionally, preferably the top surface 114 of the sheet member 44 is configured such that products can slide thereon, such as within a gravity feed system.

As discussed above, the shelf assembly 10 includes dividers 12 which define rows that align products stored on the shelf assembly 10, and the dividers 12 keep products in one row separate from products in adjacent rows. The dividers 12 are removable from the assembly thereby providing that a width of a given row can be varied, and that the total number of rows can be varied. Because the width of the rows can be varied, the shelf assembly 10 can efficiently accommodate groups of products having different sizes. Specifically, when it is desired to display a different product on the shelf assembly 10, one or more divider members 12 can be moved, added or removed, as the case may be, quickly and easily to accommodate the different product. Additionally, because the dividers keep products in one row separate from products in adjacent rows, the shelf assembly 10 maintains the products in an orderly arrangement.

While a preferred embodiment of the present invention is shown and described, it is envisioned that those skilled in the art may devise various modifications of the present invention without departing from the spirit and scope of the appended claims.

The claimed invention is:

1. An adjustable shelf assembly for storing products comprising:

a base;

a generally upstanding front member having a length and including a plurality of teeth defining a plurality of slots along the length, wherein the front member and the base include interlocking structure for removably interlocking the front member and the base together, the interlocking structure comprising a T-shaped protrusion of the front member and a T-shaped recess defined by the base receiving the T-shaped protrusion; and a plurality of generally upstanding dividers removably engageable at alternative locations along the length of the front member for forming a plurality of rows and adjusting the number and width of the rows, wherein each divider is adapted to at least one of:

be alternatively and adjustably received within the slots defined by the teeth of the front member; and alternatively and adjustably receive the teeth of the front member.

2. The adjustable shelf assembly of claim 1 wherein said dividers generally have an inverted U-shaped cross-section.

3. The adjustable shelf assembly of claim 1 wherein the slots are defined by a plurality of walls of the front member and are positioned in spaced apart relation along the length of the front member.

4. The adjustable shelf assembly of claim 1 wherein the base and front member are configured such that when the base and front member are interlocked together, the base and the front member generally form a ninety degree angle.

5. An adjustable shelf assembly for storing products comprising:

a base, a generally upstanding front member having a length and including a plurality of teeth defining a plurality of slots along the length, wherein the front member and the base include interlocking structure for removably interlocking the front member and the base together: and a plurality of generally upstanding dividers removably engageable at alternative locations along the length of the front member for forming a plurality of rows and adjusting the number and width of the rows, wherein each divider is adapted to at least one of:

be alternatively and adjustable received within the slots defined by the teeth of the front member: and alternatively and adjustable receive the teeth of the front member:

wherein the base and front member are configured such that when the base and front member are interlocked together, the base and the front member generally form a ninety degree angle, said shelf assembly further comprising a plate member, wherein said front member and said plate member are configured such that said plate member is removably attachable to the front member for supporting the products upstanding on the shelf assembly to prevent the products from falling forward off the shelf assembly, wherein when said plate member is removably attached to said front member, said plate member and said base generally form a ninety degree angle.

6. The adjustable shelf assembly of claim 1 further comprising a sheet member adapted to rest on the base.

7. The adjustable shelf assembly of claim 1 further comprising a rear member associated with the base including a plurality of teeth defining a plurality of slots complementary to the slots in the front member.

8. The adjustable shelf assembly of claim 1 wherein the front member includes a plurality of alternating slots and teeth, and wherein the dividers are configured such that they can be alternatively and adjustably received within the slots defined by the teeth of the front member and can alternatively and adjustably receive the teeth of the front member.

9. The adjustable shelf assembly of claim 8 wherein a width of at least one of the slots defined by the teeth of the front member is generally equal to a width of at least one of the teeth defined by the front member.

10. The adjustable shelf assembly of claim 1 wherein the base is configured for securement to a shelf surface.

11. The adjustable shelf assembly of claim 10 wherein the base defines a plurality of holes for securing the base to the shelf surface, the holes being arranged in spaced apart relation along a length of the base.

12. The adjustable shelf assembly of claim 11 wherein said plate member is configured such that products can generally be seen through the plate member.

13. The adjustable shelf assembly of claim 12 wherein the front member defines a channel and the plate member is removably received in the channel.

14. The adjustable shelf assembly of claim 1 further comprising a plate member, wherein said front member and said plate member are configured such that said plate member is removably attachable to the front member for supporting products on the shelf assembly.

15. An adjustable shelf assembly for storing products comprising:

a generally upstanding front member having a length and including a plurality of teeth defining a plurality of slots along the length;

a plate member, wherein said front member and said plate member are configured such that said plate member is removably attachable to the front member for supporting the products upstanding on the shelf assembly to prevent the products from falling forward off the shelf assembly; and a plurality of generally upstanding dividers removably engageable at alternative locations along the length of the front member for forming a plurality of rows and adjusting the number and width of the rows, wherein each divider is adapted to at least one of:

be alternatively and adjustably received within the slots defined by the teeth of the front member; and alternatively and adjustably receive the teeth of the front member.

16. The adjustable shelf assembly of claim 15 wherein the front member includes a plurality of alternating slots and teeth, and wherein the dividers are configured such that they can be alternatively and adjustably received within the slots defined by the teeth of the front member and can alternatively and adjustably receive the teeth of the front member.

17. The adjustable shelf assembly of claim 16 wherein a width of at least one of the slots defined by said front member is generally equal to a width of at least one of the teeth defined by said front member.

18. The adjustable shelf assembly of claim 16 wherein the dividers generally have an inverted U-shaped cross-section.

19. The adjustable shelf assembly of claim 15 wherein the plate member is configured such that products can generally be seen through the plate member.

20. The adjustable shelf assembly of claim 15 further comprising a base, wherein the base and front member are configured to interengage together.

21. The adjustable shelf assembly of claim 20 wherein the front member and the base include interlocking structure for removably interlocking the front member and the base together.

22. The adjustable shelf assembly of claim 21 wherein the base and front member are configured such that when the base and front member are interlocked together, the base and the front member generally form a ninety degree angle.

23. The adjustable shelf assembly of claim 10 wherein the base is configured for securement to a shelf surface.

24. The adjustable shelf assembly of claim 23 wherein the base defines a plurality of holes for securing the base to a shelf surface, the holes being arranged in spaced apart relation along a length of the base.

25. The adjustable shelf assembly of claim 20 wherein the base and front member are configured such that when the base and front member are interlocked together, the base and the front member generally form a ninety degree angle, wherein when said plate member is removably attached to said front member, said plate member and said base generally form a ninety degree angle.

26. The adjustable shelf assembly of claim 20, further comprising a rear member associated with the base including a plurality of teeth defining a plurality of slots complementary to the slots in the front member.

27. The adjustable shelf assembly of claim 15 wherein the dividers are generally rectangular shaped.

28. The adjustable shelf assembly of claim 15 wherein the slots are defined by a plurality of walls of the front member and are positioned in spaced apart relation along the length of the front member.

29. The adjustable shelf assembly of claim 15 wherein the front member defines a channel and the plate member is removably received in the channel.

30. The adjustable shelf assembly of claim 15 further comprising a sheet member adapted to rest on the base.

31. The adjustable shelf assembly of claim 1 wherein the protrusion extends substantially the entire length of the front member and the recess extends substantially the entire width of the base.

* * * * *